US008858418B2

(12) United States Patent
Chilton, III

(10) Patent No.: US 8,858,418 B2
(45) **Date of Patent: *Oct. 14, 2014**

(54) METHOD AND APPARATUS FOR PROVIDING TREATMENT IN A WARMING DEVICE

(75) Inventor: Robert Joseph Chilton, III, Quakertown, PA (US)

(73) Assignee: Draeger Medical Systems, Inc., Telford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/229,223

(22) Filed: Sep. 9, 2011

(65) Prior Publication Data

US 2011/0319702 A1 Dec. 29, 2011

Related U.S. Application Data

(62) Division of application No. 11/999,443, filed on Dec. 5, 2007, now Pat. No. 8,079,949.

(51) Int. Cl.
*A61G 11/00* (2006.01)

(52) U.S. Cl.
CPC ..... *A61G 11/00* (2013.01); *A61G 11/005* (2013.01)
USPC ..... 600/22

(58) Field of Classification Search
USPC ..... 600/22, 538; 5/658; 128/204.25, 204.26
See application file for complete search history.

(56) References Cited

U.S. PATENT DOCUMENTS

| | | | | |
|---|---|---|---|---|
| 2,820,477 | A | 1/1958 | Dorsak et al. | |
| 3,318,308 | A | 5/1967 | Grosholz | |
| 3,999,541 | A | 12/1976 | Tabor | 128/191 |
| 4,121,571 | A | 10/1978 | Pickering | 128/1 B |
| 4,161,172 | A | 7/1979 | Pickering | 128/1 B |
| 4,425,914 | A * | 1/1984 | Ray et al. | 128/200.14 |
| 4,481,938 | A | 11/1984 | Lindley | 128/30 |
| 4,537,188 | A * | 8/1985 | Phuc | 128/200.21 |
| 4,681,100 | A | 7/1987 | Brychta et al. | 128/204.25 |
| 5,125,889 | A | 6/1992 | Snyders | 600/22 |
| 5,954,627 | A | 9/1999 | Sekine et al. | 600/22 |
| 6,367,476 | B1 | 4/2002 | Conn | 128/205.26 |
| 2004/0186341 | A1 | 9/2004 | McDermott | 600/22 |
| 2006/0004297 | A1 * | 1/2006 | Orr et al. | 600/538 |

FOREIGN PATENT DOCUMENTS

| | | | |
|---|---|---|---|
| EP | 0974325 | 1/2000 | A61G 11/00 |

* cited by examiner

*Primary Examiner* — Christine Matthews
(74) *Attorney, Agent, or Firm* — DLA Piper LLP (US)

(57) ABSTRACT

An apparatus and method for performing warming therapy is described. In one exemplary embodiment, the apparatus includes a patient support platform, a patient chamber, a heating source, and a rigid connection member for connecting hoses to the patient chamber. The rigid connection member provide an interface between hoses disposed inside the patient chamber, and hoses disposed outside. The connection member preferably includes one or more interconnection nozzles, removably attached thereto, for connecting the internal hoses to the external hoses. Each of the interconnection nozzles preferably includes an interior connection surface exposed to an interior of the patient chamber, and an external connection surface exposed to an external of the patient chamber.

16 Claims, 9 Drawing Sheets

METHOD AND APPARATUS FOR PROVIDING TREATMENT IN A WARMING DEVICE

RELATED APPLICATION

This application is a divisional of U.S. patent application Ser. No. 11/999,443 filed on Dec. 5, 2007, the subject matter of which is incorporated herein by reference.

FIELD OF THE INVENTION

This present invention relates generally to a method and apparatus for providing treatment in a warming therapy device for medical patients. More particularly, the present invention relates to a method and apparatus for providing treatment from an external source, such as a ventilator, through hoses coupled to a rigid connection member.

BACKGROUND OF THE INVENTION

Conventional devices for performing warming therapy apply heat to the body of a patient situated on a mattress. Such devices are often used, for example, to warm infants immediately after they are born.

One such conventional warming therapy device is shown in FIG. 1 of the present application. In particular, FIG. 1 shows a warming device 100, which includes a patient support platform or mattress 101, and a warming lamp 106. The warming lamp 106 provides energy, in the form of infrared (IR) radiation, onto the mattress 101, and any patient which is situated thereon. The warming device also includes a hood 102, for use in providing an enclosed therapeutic environment, or patient chamber 120. Supplemental medical treatment, such as ventilation for example, may be provided by an ventilation device 112. As shown in FIG. 1, one or more ventilation hoses 111 may be coupled to the ventilation device 112 at one end by ventilation nozzles 113. The other ends of the ventilation hoses 111 are preferably inserted into the hood 102 via small openings 110. Once the ventilation hoses 111 are inside the hood 102, they may be coupled to the patient through intubation or other known procedures. The small openings 110 in the hood 102 may be lined with grommets or other means to prevent the escape of air at the point of connection. The warming device 100 may also include large openings 108 in the hood 102 for enabling the ventilation hoses 111 to be connected directly to the patient.

However, in the above-described conventional warming device 100, the risks associated with extubation (i.e., the removal of the ventilation hoses from the airway of the patient), and contamination are significantly high. Particularly, since the ventilation hoses 111 provide a direct connection between the external ventilation device 112 and a patient residing in the patient chamber 120, any sudden pull or yanking on the ventilation hoses 111 could result in unintentionally extubating the patient, and ultimately causing serious injury to the patient. Further, since the ventilation hoses 111 I must be routed from outside of the warming device 100 to the inside, dirt and other contaminants may be inadvertently introduced into the patient treatment environment (including, e.g., the patient chamber 120, hood 102 and hoses 111), resulting in illness and/or disease.

Accordingly, there is presently a need for a warming device that reduces or eliminates some of the risks associated with unintentional extubation, and unnecessary contamination.

SUMMARY OF THE INVENTION

An exemplary embodiment of the present invention comprises an apparatus including a patient support platform and a connection member for providing an interface between a patient and one or more treatment devices, wherein the connection member includes one or more interconnection nozzles, each interconnection nozzle including a first side for receiving one or more internal hoses and a second side for receiving one or more external hoses.

An exemplary embodiment of the present invention also comprises a connection member for use in providing an interface between a medical patient and one or more treatment devices, the member including a main body and one or more interconnection nozzles coupled to the main body, each of said one or more interconnection nozzles including a first side for receiving one or more internal hoses and a second side for receiving one or more external hoses.

An exemplary embodiment of the present invention also comprises a method for providing treatment to a medical patient, including the steps of coupling at least one first hose to at least one medical patient and a first side of a first interconnection nozzle disposed in connection member, coupling at least one second hose to a second side of the interconnection nozzle and, applying medical treatment to the at least one second hose so that the medical treatment passes through the at least one second hose, the interconnection nozzle, the at least one first hose, and to the medical patient.

DETAILED DESCRIPTION

The present invention relates to a warming device including an internal connection member for providing a strain-releasing interface. In a first exemplary embodiment, a rigid connection member provide an interface connecting ventilation hoses disposed inside of a patient chamber to ventilation hoses disposed externally. The rigid connection member is preferably coupled to a patient support platform, so as to prevent movement. The rigid connection member includes a plurality of differently-sized interconnection nozzles which are removably disposed in the rigid connection member. One face of the rigid connection member is disposed so as to face the exterior of the patient chamber, and another face is disposed so as to face the interior of the patient chamber. In a second exemplary embodiment, the warming device is configured as an integrated warming/therapy device comprising one or more treatment devices integrated into the warming device. In such an embodiment, the rigid connection circuit is configured to define an internal channel for concealing the external connection surfaces of the nozzles, and any external hoses connected thereto. In a third exemplary embodiment, the warming device is configured to have a rotating patient support platform. In a fourth exemplary embodiment the warming device is configured to have a rotating patient support platform and one or more integrated treatment devices.

Figure 1:
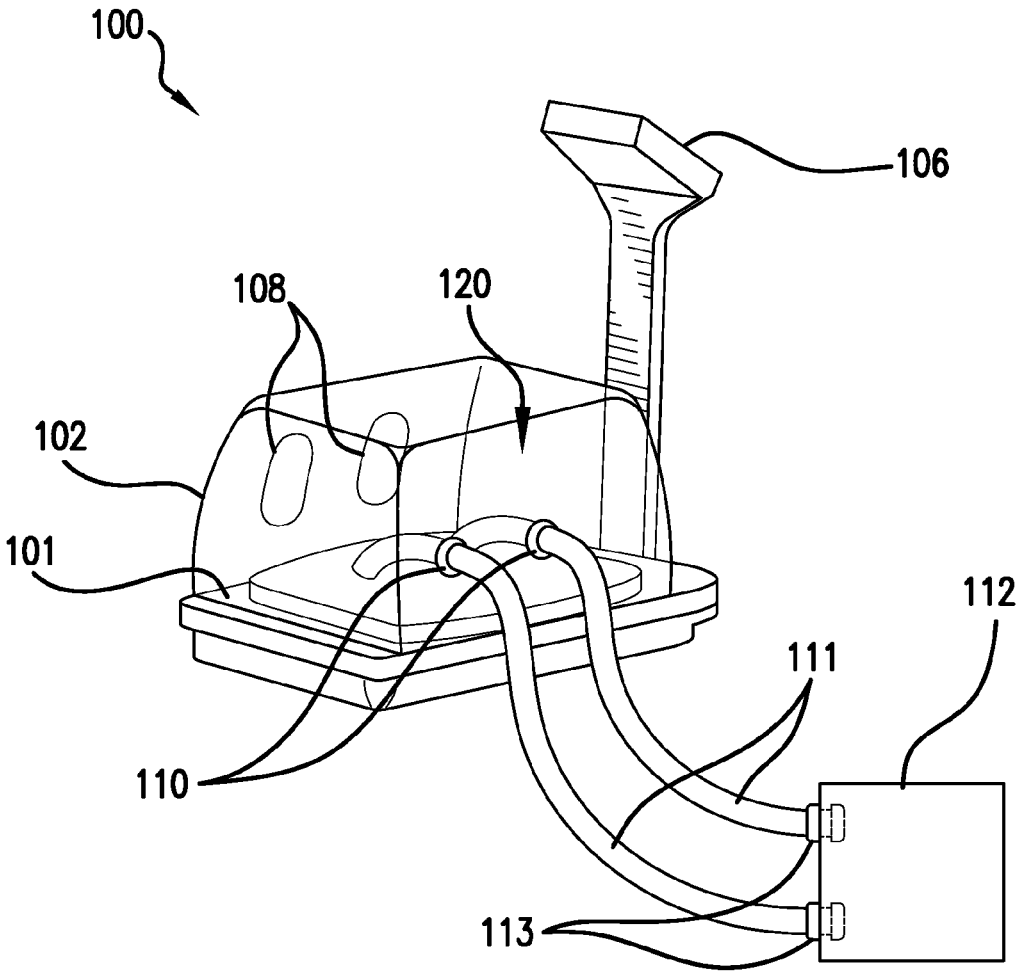
FIG.1 PRIOR ART
FIG. 1 is a perspective view of a conventional warming device.
Figure 2:
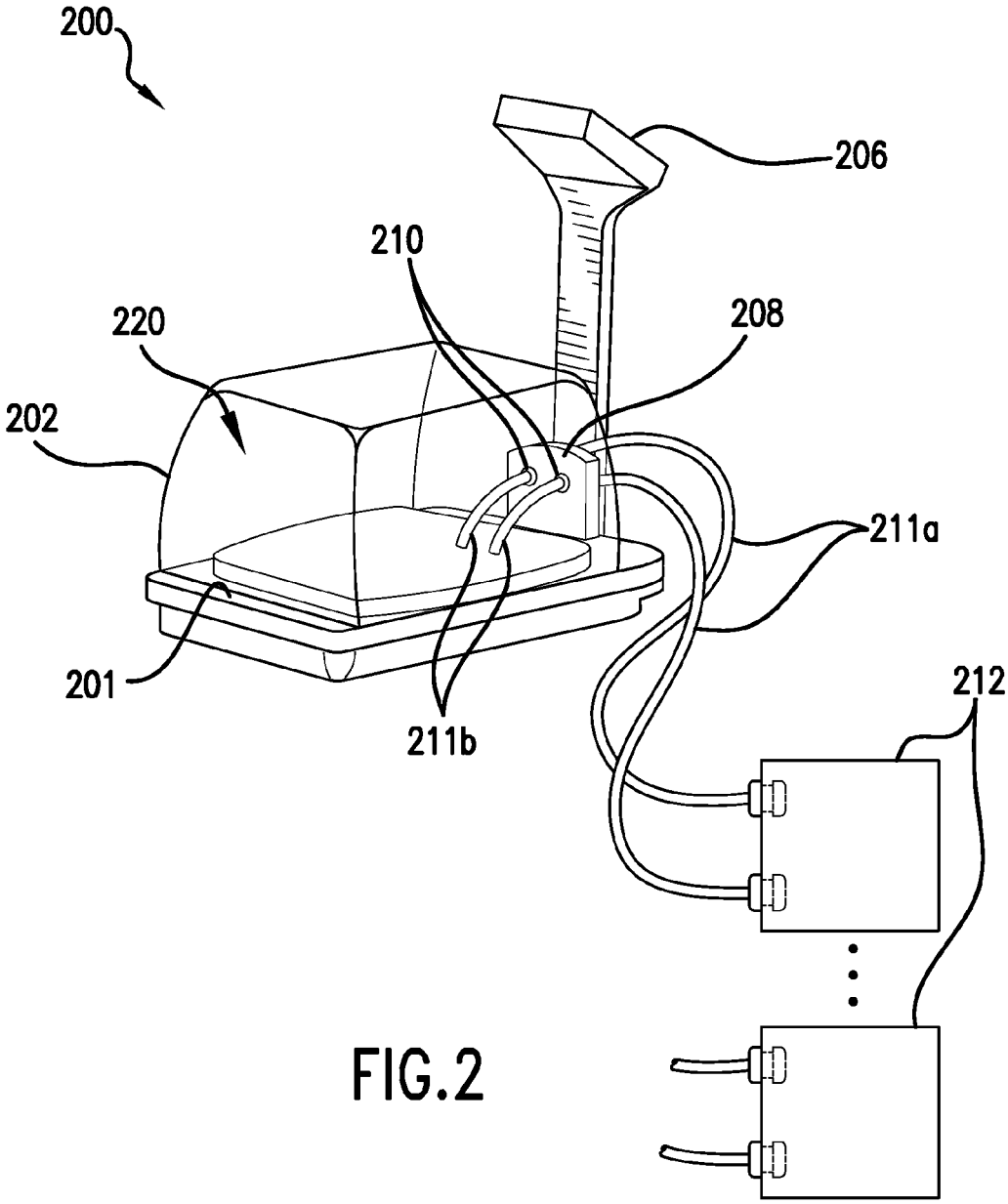
FIG. 2 is a perspective view of a warming device according to a first exemplary embodiment of the present invention.
Figure 3:
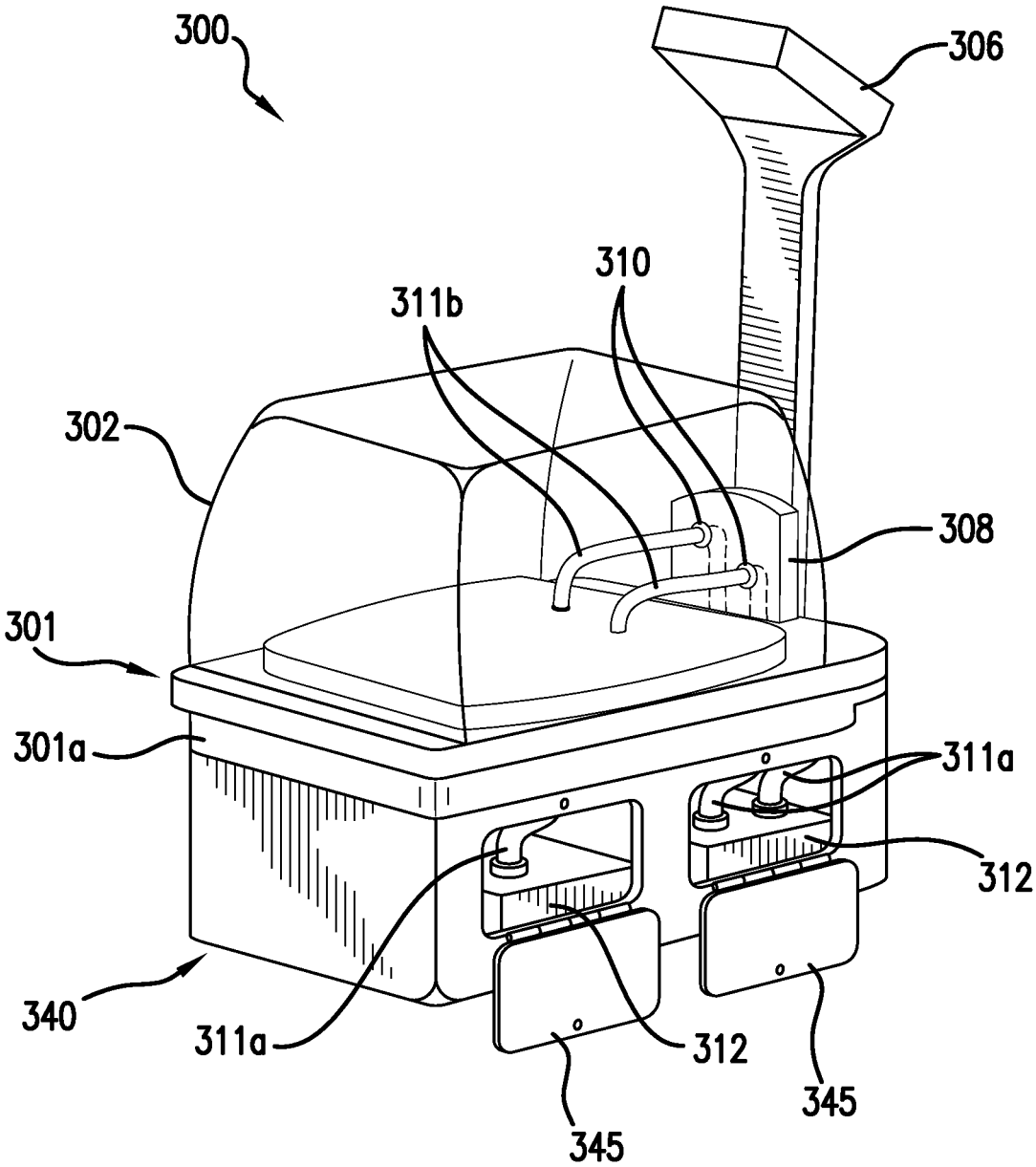
FIG. 3 is a perspective view of a warming device according to a second exemplary embodiment of the present invention.

FIG. 2 shows a warming device 200 according to a first exemplary embodiment of the present invention. The warming device 200 includes a patient support platform 201, a radiant heat source 206, a removable hood 202, and a connection member 208. The radiant heat source 206 provide warming therapy to a patient residing on the platform 201, and the hood 202 serves to contain the warmth of the heat, and keep out contaminants. The radiant heat source 206 may comprise an infrared (IR) heating device or the like. The warming device may also include one or more external treatment devices 212 (e.g., ventilator), for providing medical treatment to the patient through one or more external and internal hoses 211*a*, 211*b*. The external treatment devices 212 may be independent stand alone devices, as is shown in FIG. 2, or may be integrated with the warming device 200, so as to appear concealed to the ordinary observer, as shown in FIG. 3.

The connection member 208 may be coupled to the patient support platform 201, the hood 202, or to any other medical device in the proximity of the warming device 200. Preferably, the connection member 208 is coupled to the patient support platform 201, so that it can be used both when the hood 202 is present, and when it is not present. The connection member 208 may be removably coupled to the patient support platform 201, hood 202, or other device, or fixedly coupled thereto. If removably coupled, it is preferable to include a locking mechanism for the connection member 208, so that it is not inadvertently removed from the patient support platform 201, hood 202, or other device. Any locking mechanism known to those of ordinary skill in the art may be utilized in accordance with the present invention.

In operation, the warming device 200 preferably provides warming therapy to a patient when the hood 202 is disposed over the patient, and the device 200 is operated as a "closed care" therapy device. However, it will be noted by those of ordinary skill in the art that the present invention is not so limited. Indeed, the connection member 208 described above may be used in conjunction with any known patient therapy device, including but not limited to, "open care" and "hybrid care" devices.

As will be understood by those of ordinary skill in the art, "open care" therapy devices are similar to "closed care" devices in that they may also include patient support platforms and radiant heat sources. However, unlike "closed care" devices, "open care" devices typically do not include a hood. Instead, "open care" devices typically include adjustable side walls connected to the patient support platform for limiting the movement of a patient disposed within the device.

"Hybrid care" devices are typically configured as a combination of "closed care" and "open care" devices. For example, similar to "closed care" devices, "hybrid care" devices include removable hoods for providing warming therapy, and similar to "open care" devices, "hybrid care" devices include side walls for restricting patient movement.

Referring again to FIG. 2, even though the warming device 200 shown in the exemplary embodiment is a "closed care" device, those of ordinary skill in the art will understand how to configure the device to be an "open," "closed" or "hybrid" care device. Additionally, the patient support platform 201 may be configured as a fixed or a rotating platform (See FIG. 4), the hood 202 may comprise a removable hood (or one that includes one or more hinged attachment points to the platform 201), and the radiant heat source 206 may comprise resistive heating devices, or any other type of heating element known to those of ordinary skill in the art.

The connection member 208 is configured to provide a rigid, strain-releasing interface between the internal hoses 211*b* connected to the medical patient, and external hoses 211*a* connected to the one or more treatment devices 212. The connection member 208 may be fixedly attached (or integrated into) virtually any portion of the warming device 200, such as for example, the patient support platform 201. Alternatively, the connection member 208 may be removably attached to a portion of the warming device 200 (e.g., the patient support platform 201) via any fastening means known to those of ordinary skill in the art.

Figure 2A:
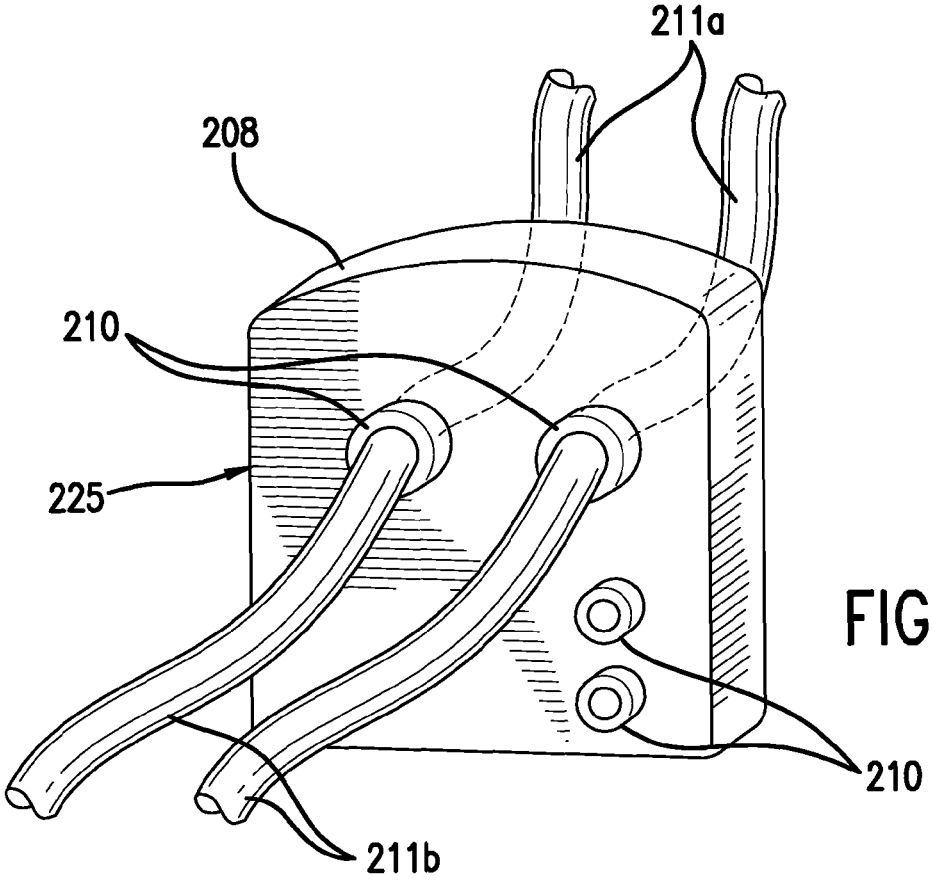
FIG. 2A is a detail perspective view of the connection member of the warming device shown in FIG. 2.

FIG. 2A shows a detail view of the connection member 208. As shown, the connection member 208 includes a main body 225, and one or more interconnection nozzles 210 of differing shapes, each nozzle being removably integrated into the rigid main body 225 of the connection member 208. The interconnection nozzles 210 permit the connection of hoses of differing sizes and configurations to both sides thereof. As shown in FIG. 2A, the interconnection nozzles 210 permit the connection of external hoses 211*a* to one side thereof, and internal hoses 211*b* to an opposite side thereof. Each interconnection nozzle 210 includes an interior connection surface 215 and an exterior connection surface 216 (See FIG. 213), each of which are preferably configured as a "quick-connect"/"quick-release" connection points. As is known to those of ordinary skill in the art, a "quick-connect"/"quick-release" nozzle connection point is a coupling arrangement fitted onto or formed within a nozzle end for facilitating the "quick" coupling and decoupling of a hose end thereto. As the hose end is passed through the "quick-connect"/"quick-release" nozzle end, a locking mechanism within the coupling arrangement gradually engages a complimentary locking surface formed into or fitted onto the hose end until the hose end is in a locked position. To remove or decouple the hose end from the nozzle end, the locking mechanism is simply released and/or the hose end is pulled with sufficient force to disengage its locking surface from that of the nozzle. One advantage of using such connection points is the speed with which hoses may be coupled to, and decoupled from, the respective nozzles. Particularly, the "quick-connect"/"quick-release" nozzle connections enable users to manually connect and disconnect hoses, without the aid of tools or other equipment.

To provide added versatility and interconnectivity, the interconnection nozzles 210 may be sized and configured to accommodate various types of hoses including, for example, suction hoses, oxygen hoses, intravenous hoses, breathing hoses, fluid hoses, and/or any other type of medical treatment hose known to those of ordinary skill in the art. Although the interconnection nozzles 210 are shown as number 3 pairs, and being circular and diamond-shaped, in FIG. 2A, those of ordinary skill in the art will realize that the connection member 208 can include any number of interconnection nozzles 210 of varying geometric shapes without departing from the scope of the invention.

Optionally, one or more of the interconnection nozzles 210 may include therein an air sensor (not shown) for monitoring the amount of oxygen drawn through the nozzle, and thus through the external therapy device 212 and hoses 211*a*, 211*b*. Such an air sensor may comprise any air sensor known to those of ordinary skill in the art capable of measuring air flow rate. Additionally or alternatively, one or more of the interconnection nozzles 210 may include an air humidifying element (not shown) for introducing moisture into the air as it passed through the interconnection nozzles 210 into the interior of the patient chamber 220. Such an element may comprise any air humidifying element known to those of ordinary skill in the art. In yet another alternative embodiment, one or more of the interconnection nozzles 210 may include one or more heating elements (not shown) for warming air as it passes through the interconnection nozzles 210 and into the interior of the patient chamber 220. Such a heating element may comprise any element or device known to those of ordinary skill in the art capable of heating air.

In operation, a patient is positioned onto the patient support platform 201 to receive warming therapy from the radiant heat source 206. Additional therapy and/or treatment may be provided to the patient via the one or more external treatment devices 212. These external treatment devices 212 may include any medical treatment device known to those of ordinary skill in the art, including but not limited to, ventilation devices, intravenous treatment devices, oxygen pumps, and the like. As noted above, one or more of the external treatment devices 212 may comprise independent, stand alone devices; or they may comprise integrated devices, formed into the body of the warming device 200.

Figure 2B:
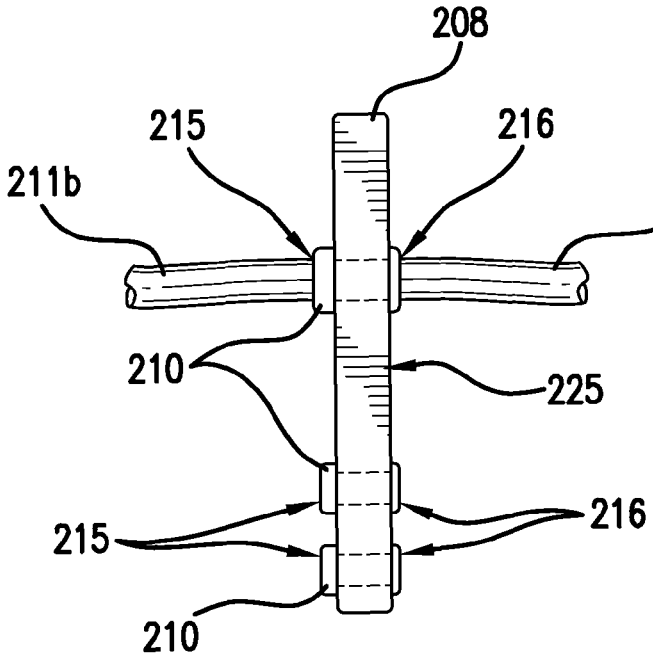
FIG. 2B is a detail side elevation view of the connection member of the warming device shown in FIG. 2.

Unlike conventional warming devices, which require uninterrupted hose(s) running between external treatment device (s) and a patient, the warming device 200 according to the first exemplary embodiment of the invention utilizes a series of interconnected hoses 211*a*, 211*b* joined via a rigid connection member 208 to provide supplemental treatment to the patient. As illustrated in FIGS. 2, 2A and 2B, one or more external hoses 211*a* are used to connect one or more external treatment devices 212 to the connection member 208 via one or more interconnection nozzles 210. One or more corresponding internal hoses 211*b* are then used to connect the patient to the connection member 208 via the same interconnection nozzles 210. In this manner, a joined pathway, originating at the external treatment devices 212 and culminating at the patient, is provided. Unlike conventional pathways, however, the joined pathway of the warming device 200 utilizes a rigid connection member 208 to join internal and external hoses 211*a*, 211*b*, thereby providing a strain-releasing junction between the external treatment devices 212, and the patient.

As will be appreciated by those of ordinary skill in the art, utilizing a rigid connection member 208 in the manner described above provides added safety to the patient receiving therapy from the one or more external treatment devices 212. If, for example, an external treatment device 212 were suddenly moved, and as a result one or more external hoses 211*a* were suddenly pulled or yanked out of position, the external hoses 211*a* would simply become disconnected from the connection member 208, while the internal hoses 211*b* would remain intact, thus resulting in no pain or injury to the patient. If, however, a hose in a conventional device were suddenly pulled or yanked out of position, the hose would likely be partially or completely extubated, resulting in pain and injury to the patient.

The connection member 208 also reduces and/or eliminates the possibility of contamination within the interior of the patient chamber 220 of the warming device 200. As discussed above, conventional hoses are typically routed through openings in the hood of the warming device, and subsequently connected directly to the patient. In the course of such routing, dirt and other contaminants may be inadvertently introduced into the hoses or some other portion of the patient treatment environment (including, e.g., the patient chamber 220, the hoses 211*a*, 211*b*, and the hood 202), thereby resulting in disease or infection. Alternatively, the connection member 208 does not require the routing of any hoses from the outside of the warming device 200 to the inside in order to provide treatment. Rather, the internal hoses 211*b* remain in the same general location, and only the external hoses are changed when switching between external treatment devices 212. Particularly, the connection member 208 provides an interface for connecting the external hoses 211*a* to the internal hoses 211*b* while maintaining the external hoses 211*a* outside of the patient's treatment environment. In this manner, inadvertent dirt and other contaminants within the patient chamber 220 are substantially reduced, and such particles and contaminants are prevented from entering and contaminating the patient treatment environment. To further reduce the chances of contaminating the patient treatment environment, the interconnection nozzles 210 may be configured as disposable nozzles. Thus, once used, the interconnection nozzles 210 may be discarded and replaced with new, sanitized nozzles.

FIG. 3 shows a warming device 300 according to a second exemplary embodiment of the present invention, where one or more treatment devices are integrated into the warming device 300. The warming device includes a patient support platform 301, a radiant heat source 306. a removable hood 302, and a connection member 308. The radiant heat source 306 may comprise an infrared (IR) heating device or the like. The warming device 300 also includes one or more treatment devices 312, for providing medical treatment to the patient through one or more external and internal hoses 311*a*, 311*b*. In this exemplary embodiment, the connection member 308 may be configured to additionally provide an internal channel 330 for concealing the external connection surfaces 316 of the nozzles 310, and any external hoses 311*a* connected thereto. Optionally, such an 'integrated' warming device may further comprise a housing element 340 configured to conceal any integrated treatment devices 312, the external connection surfaces 316 of one or more interconnection nozzles 310, and/or any external hoses 311*a* connected between the integrated treatment devices and the external connection surfaces 316.

Figure 3A:
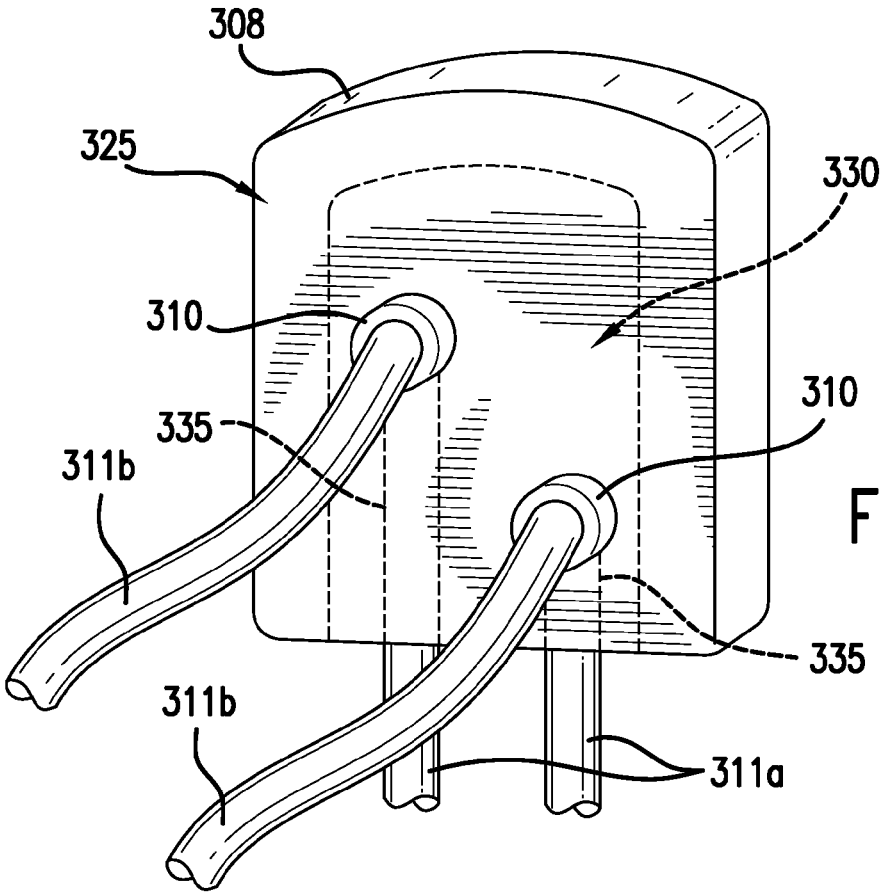
FIG. 3A is a detail perspective view of the connection member of the warming device shown in FIG. 3.
Figure 3B:
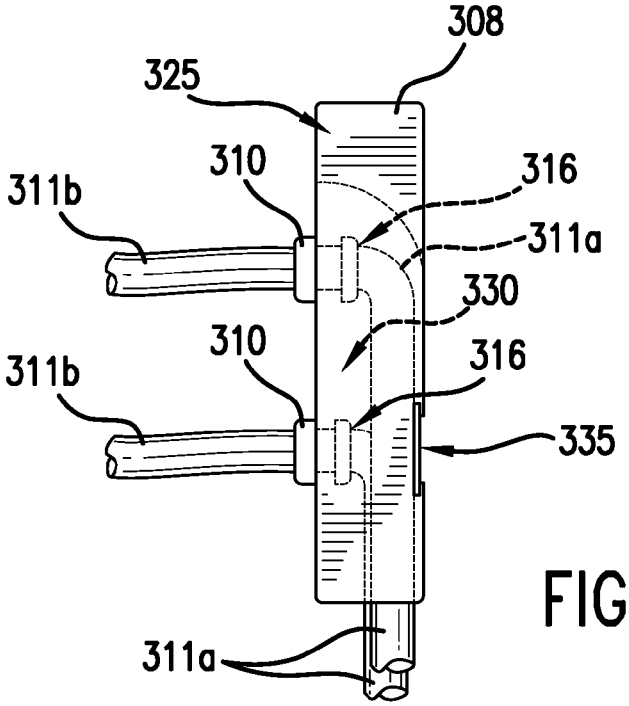
FIG. 3B is a detail side elevation of the connection member of the warming device shown in FIG. 3.

FIGS. 3A shows a detail perspective view of the connection member 308. As shown, the connection member 308 includes a main body 325, one or more interconnection nozzles 310 removably integrated therein, and an internal channel 330 formed within the connection member 308 for concealing the external connection surfaces 316 of the nozzles 310, and the external hoses 311*a* connected thereto (see FIG. 3B). The internal channel 330 of this exemplary embodiment is configured to define one or more channel pathways 335 for guiding the external hoses 311 along specific routes to corresponding treatment device 312 stowed beneath the patient support platform 301, and for preventing the hoses 311*a* from becoming entangled. Alternatively, as will be realized by those skilled in the art, the internal channel 330 may be configured as a single channel pathway (as opposed to multiple pathways) without departing from the scope of the present invention.

Referring again to FIG. 3, the housing element 340 is shown coupled to a bottom portion 301*a* of the patient support platform 301. As shown, the housing element 340 is configured for encasing the integrated treatment devices 312, and for concealing the external hoses 311*a* coupled thereto. Access to the integrated treatment devices 312 and hoses 311*a* may be provided by uncoupling the housing element 340 from the platform 301, and/or by way of one or more access doors 345 defined in the housing element 340. As shown, the access doors 345 are configured as hinged panels along a side of the housing element 340 that when opened, expose the integrated treatment devices 312, and the external hoses 311*a* connected thereto. As will be realized by those of ordinary skill in the art, fewer or more access doors 345 having similar or alternate configurations may be provided in accordance with the present invention.

Figure 4A:
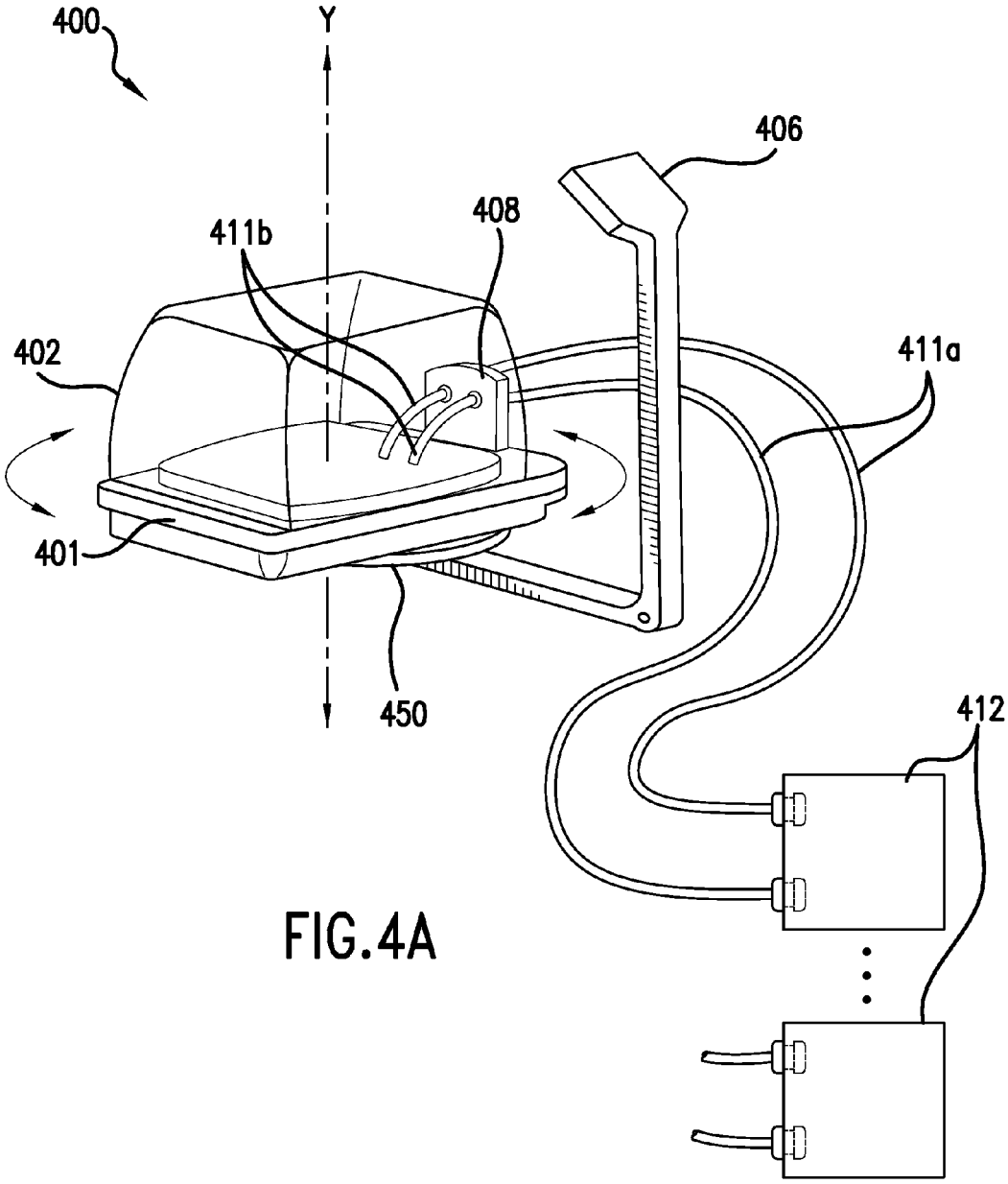
FIG. 4A is a perspective view of a warming device according to a third exemplary embodiment of the present invention.

FIG. 4A shows a warming device 400 according to a third exemplary embodiment of the present invention, including a rotatable patient support platform 401, a radiant heat source 406, a removable hood 402, and a connection member 408. The radiant heat source 406 may comprise an infrared (IR) heating device or the like. The warming device 400 also includes one or more treatment devices 412, for providing medical treatment to the patient through one or more external and internal hoses 411*a*, 411*b*. The patient support platform 401, shown in a rotated position, preferably includes a rotary mechanism 450 integrated into an underside of the platform 401 for rotating the platform 401 about a vertical axis Y. Any known rotary mechanism, such as a turntable device, for example, may be utilized in accordance with the present invention. Although the platform 401 of the present embodiment is configured to rotate about its central axis, those in the art will appreciate that the platform 401 may be configured to rotate about any axis, as required for the particular embodiment.

As shown, the connection member 408 of this exemplary embodiment is directly coupled to the patient support platform 401. As will be understood by those in the art, directly coupling the connection member 408 to the platform 401 enables the member 408 to rotate in unison with the platform 401, thereby maintaining a relative positional relationship between the connection member 408, any internal hoses 411*b* connected thereto, and a patient receiving treatment through the internal hoses 411*b* from one or more treatment devices 412. In such an embodiment it is necessary to position the treatment devices 412 and the external hoses 411*a* so that they do not interfere with the radiant heat source 406. In particular, the treatment devices 412 and external hoses 411*a* should preferably be positioned above the hood 402, so that the rotation of the patient support platform 401 about the axis "Y" does not cause the arm of the radiant heat source 406 to contact the external hoses 411*a* and pull them from the connection member 408. Alternatively, the treatment device 412 may be coupled to the patient support platform 401 (through a tether or otherwise) in such as manner as to rotate with the patient support platform, and thus avoid entanglement with the arm of the radiant heat source 406.

Figure 4B:
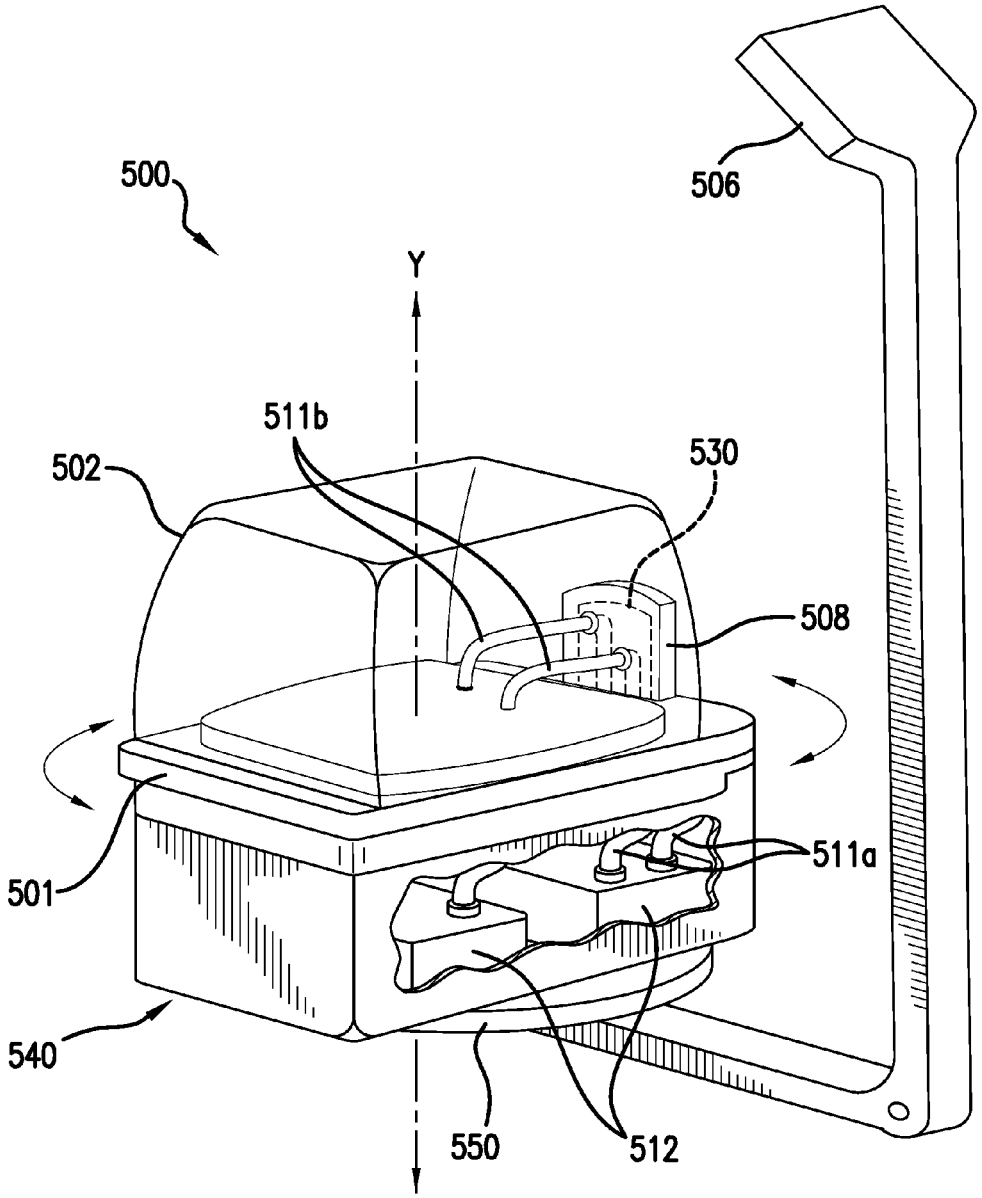
FIG. 4B is a perspective view of a warming device according to a fourth exemplary embodiment of the present invention.

FIG. 4B shows a warming device 500 according to a fourth exemplary embodiment of the present invention, including a rotatable patient support platform 501, a radiant heat source 506, a removable hood 502, and a connection member 508. The radiant heat source 506 may comprise an infrared (IR) heating device or the like. The warming device 500 also includes one or more treatment devices 512, integrated into the warming device 500 in a manner similar to that discussed above with regard to FIG. 3. In such an embodiment, the warming device 500 further comprises a housing element 540 directly coupled the rotating support platform 501, and the rotary mechanism 550 may be integrated to an underside of the housing element 540. In addition, the connection member 508 is configured to define an internal channel 530 for concealing external hoses 511*a* and for internally routing the hoses to the treatment devices 512 residing in the housing element 540. As will be understood by those of ordinary skill in the art, configuring the warming device 500 in this manner will enable a relative positional relationship between the connection member 508, the internal hoses 511*b*, the treatment devices 512, the external hoses 511*a*, and a patient receiving treatment from the treatment devices 512 through the external 511*a* and internal hoses 511*b* to be more easily maintained as the platform 501 is rotated.

Figure 5:
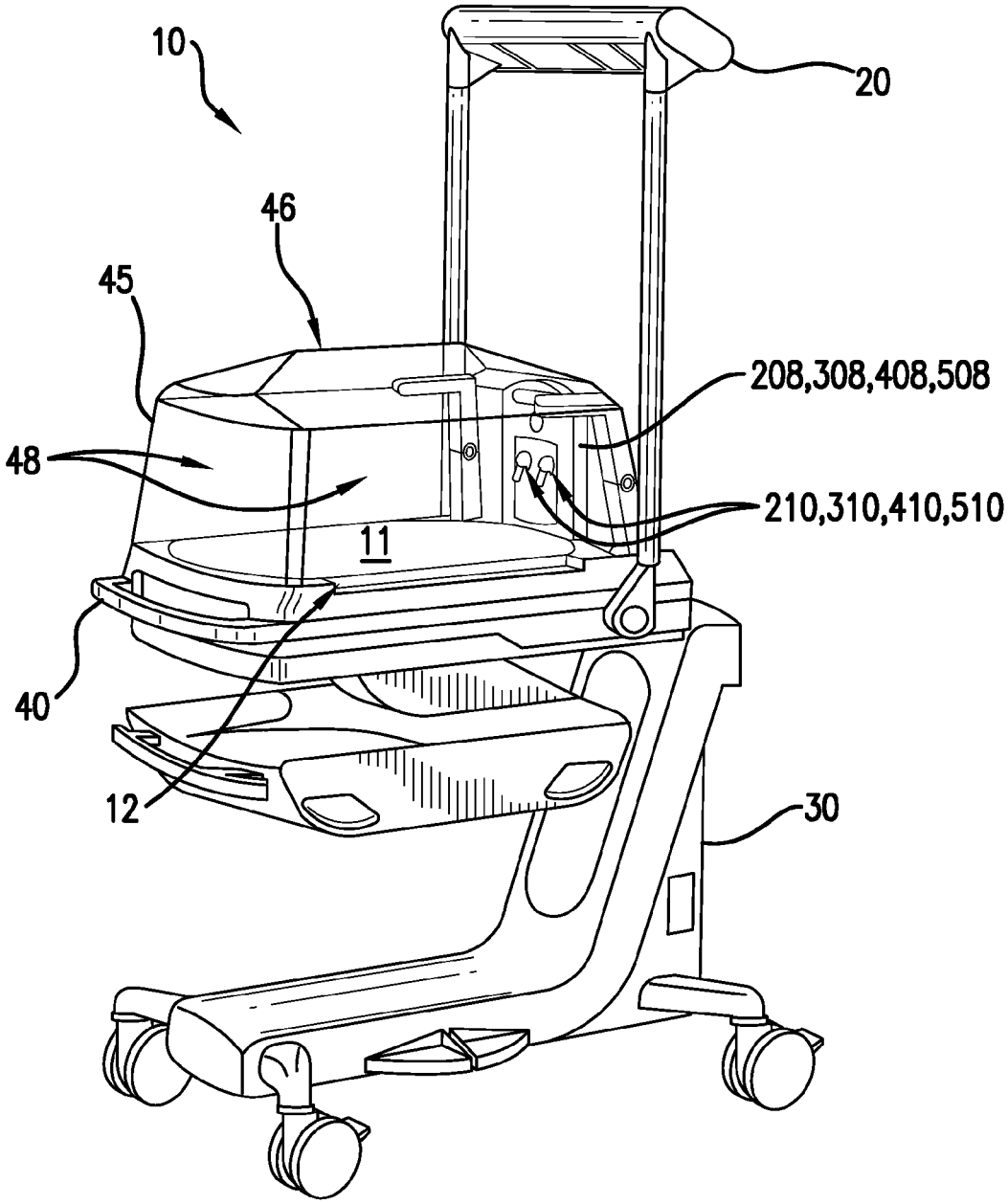
FIG. 5 is a perspective view of an incubator device according to first exemplary embodiment of the present invention.

FIG. 5 shows an incubator device 10 according to a first exemplary embodiment of the present invention in which one of the connection members 208, 308, 408 or 508 may be implemented. The incubator device 10 includes a radiant heat source 20, a patient support assembly 30, and a mattress tray assembly 40 comprising a patient support platform. The patient support assembly 30 may include a base and wheels for supporting and moving a patient disposed on the mattress tray assembly 40 (patient support platform). The radiant heat source 20 may comprise an infrared (IR) heating device or the like. The mattress tray assembly 40 may include a hood 45 with a top portion 46 and one or more sidewalls 48 which may be removable, pivotable or rotatable. The mattress tray assembly 40 also preferably includes a mattress tray 12, with a mattress II disposed therein. One of the above-described connections members 208, 308, 408, 508 may be coupled to the mattress tray assembly 40, and used to provide medical treatment (e.g., ventilation) to an infant patient disposed on the mattress 11, as shown in FIG. 5.

Figure 6:
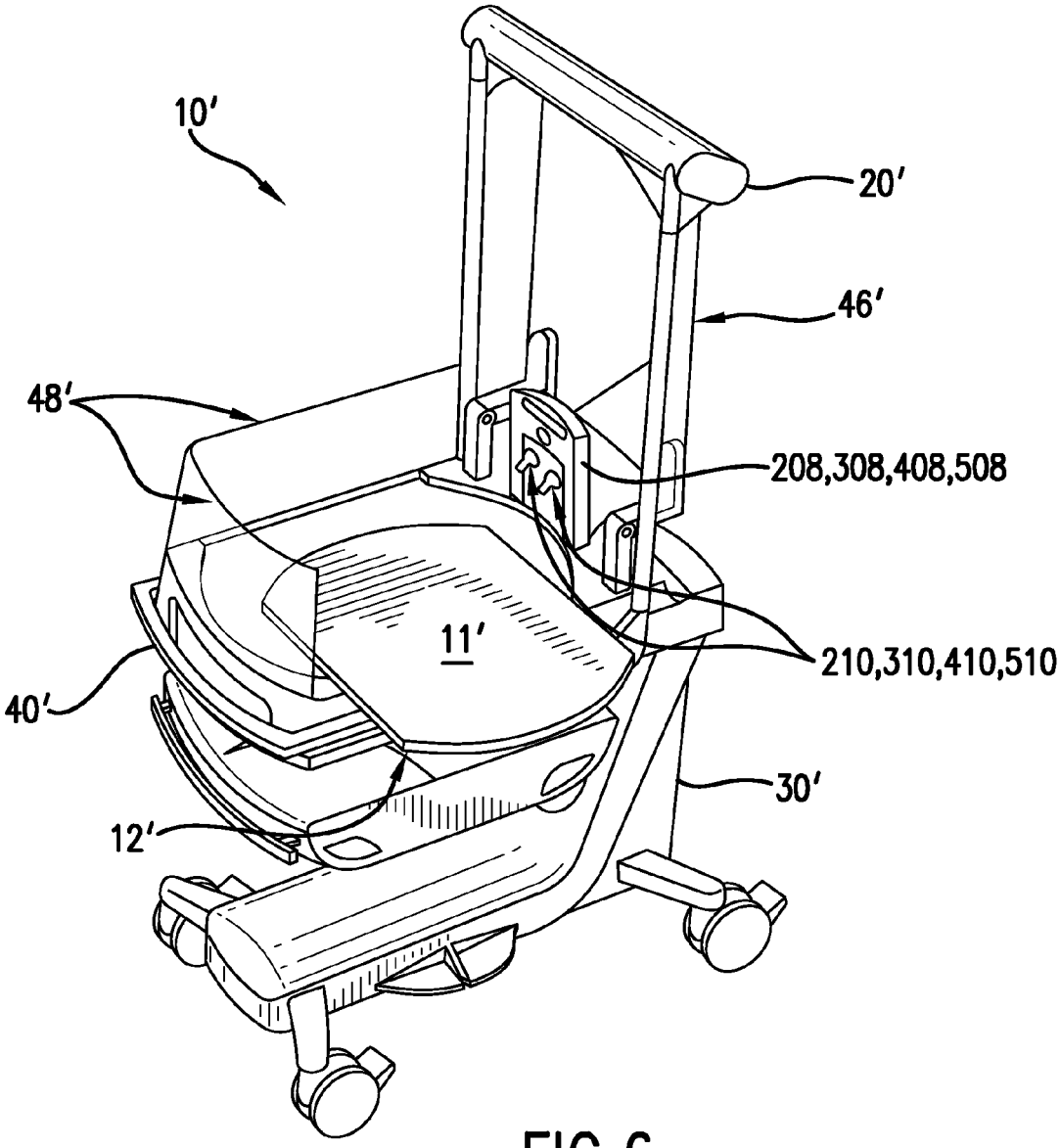
FIG. 6 is a perspective view of an incubator device according to second exemplary embodiment of the present invention.

FIG. 6 shows an incubator device 10' according to a second exemplary embodiment of the present invention in which one of the connection members 208, 308, 408 or 508 may he implemented. The incubator device 10' includes many of the same elements as the incubator device 10, and like reference numerals denote like elements. The incubator device 10' includes a radiant heat source 20', a patient support assembly 30', and a mattress tray assembly 40' comprising a patient support platform. The patient support assembly 30' may include a base and wheels for supporting and moving a patient disposed on the mattress tray assembly 40' (patient support platform). The radiant heat source 20' may comprise an infrared (IR) heating device or the like. The mattress tray assembly 40' may include a hood 45' with a top portion 46' and one or more sidewalls 48' which may be removable, pivotable or rotatable. The mattress tray assembly 40' also preferably includes a mattress tray 12', with a mattress 11' disposed therein. One of the above-described connections members 208, 308, 408, 508 may be coupled to the mattress tray assembly 40', and used to provide medical treatment (e.g., ventilation) to an infant patient disposed on the mattress 11', as shown in FIG. 6. One difference in the incubator device 10' is that the mattress 11' and mattress tray 12' can rotate on the mattress tray assembly 40. In FIG. 6, the mattress 11' and mattress tray 12' are shown rotated ninety degrees (90°) In order to accomplish such movement, one of the side walls 48' of the hood 45' (in particular the right side wall) has been removed, and the top portion 46 of the hood has been pivoted up by approximately 90°. In this exemplary embodiment, the mattress 11' and mattress tray 12' can be rotated up to three hundred and sixty degrees (360°) as long as the front, left and right side walls 48 are removed, pivoted, or rotated out of the way.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed is:

1. A connection member for use in providing an interface between a medical patient and one or more treatment devices, the member comprising:

a main body; and, one or more interconnection nozzles coupled to the main body, each of said one or more interconnection nozzles including a first side for receiving at least one internal hose and a second side for receiving at least one external hose, wherein at least one of the one or more interconnection nozzles includes an air humidifier for humidifying air drawn through said nozzle, and wherein the first side of each of the one or more interconnection nozzles is coupled to at least one treatment device through the at least one external hose, such that liquids or gases may flow from the at least one treatment device, through the at least one external hose, through the main body, and through the at least one internal hose.

2. The connection member of claim 1, wherein the one or more interconnection nozzles are removably coupled to the connection member.

3. The connection member of claim 1, wherein the at least one treatment device is selected from the group consisting of ventilation devices, intravenous treatment devices, and oxygen pumps.

4. The connection member of claim 1, wherein the at least one external hose is selected from the group consisting of suction hoses, oxygen hoses, intravenous hoses, breathing hoses, and fluid hoses.

5. The connection member of claim 1, wherein at least one of the one or more interconnection nozzles includes an air sensor for monitoring an amount of oxygen drawn through said nozzle.

6. The connection member of claim 1, wherein at least one of the one or more interconnection nozzles are disposable.

7. The connection member of claim 1, wherein the at least one treatment device comprises a ventilator.

8. The connection member of claim 1, wherein the one or more interconnection nozzles are removably coupled to the main body.

9. A connection member for use in providing an interface between a medical patient and one or more treatment devices, the member comprising:

a main body; and, one or more interconnection nozzles coupled to the main body, each of said one or more interconnection nozzles including a first side for receiving at least one internal hose and a second side for receiving at least one external hose, wherein at least one of the one or more interconnection nozzles includes an air heater for heating air drawn through said nozzle, and wherein the first side of each of the one or more interconnection nozzles is coupled to at least one treatment device through the at least one external hose, such that liquids or gases may flow from the at least one treatment device, through the at least one external hose, through the main body, and through the at least one internal hose.

10. The connection member of claim 9, wherein the one or more interconnection nozzles are removably coupled to the connection member.

11. The connection member of claim 9, wherein the at least one treatment device is selected from the group consisting of ventilation devices, intravenous treatment devices, and oxygen pumps.

12. The connection member of claim 9, wherein the at least one external hose is selected from the group consisting of suction hoses, oxygen hoses, intravenous hoses, breathing hoses, and fluid hoses.

13. The connection member of claim 9, wherein at least one of the one or more interconnection nozzles includes an air sensor for monitoring an amount of oxygen drawn through said nozzle.

14. The connection member of claim 9, wherein at least one of the one or more interconnection nozzles are disposable.

15. The connection member of claim 9, wherein the at least one treatment device comprises a ventilator.

16. The connection member of claim 9, wherein the one or more interconnection nozzles are removably coupled to the main body.

* * * * *